US012577020B2

(12) United States Patent
Johnson

(10) Patent No.: US 12,577,020 B2
(45) Date of Patent: Mar. 17, 2026

(54) HANDLE DEVICE FOR A LID OF A COMPARTMENT

(71) Applicant: Keith Norman Johnson, Conway, SC (US)

(72) Inventor: Keith Norman Johnson, Conway, SC (US)

( * ) Notice: Subject to any disclaimer, the term of this patent is extended or adjusted under 35 U.S.C. 154(b) by 0 days.

(21) Appl. No.: 18/642,259

(22) Filed: Apr. 22, 2024

(65) Prior Publication Data

US 2024/0351747 A1 Oct. 24, 2024

Related U.S. Application Data

(60) Provisional application No. 63/461,063, filed on Apr. 21, 2023.

(51) Int. Cl.
*B65D 25/28* (2006.01)
*B65D 51/24* (2006.01)

(52) U.S. Cl.
CPC ..... *B65D 25/2826* (2013.01); *B65D 51/242* (2013.01); *B65D 2525/287* (2013.01); *B65D 2525/288* (2013.01)

(58) Field of Classification Search
CPC ..... B65D 25/2826; B65D 51/242; B65D 2525/287; B65D 2525/288; B65D 25/2835; B65D 25/2852; B65D 25/2858; F25D 3/08
USPC ..... 220/761, 762, 763, 764
See application file for complete search history.

(56) References Cited

U.S. PATENT DOCUMENTS

| | | | | |
|---|---|---|---|---|
| 337,412 | A * | 3/1886 | Long | A47B 95/02 16/415 |
| 3,035,733 | A | 5/1962 | Knapp | |
| 3,793,674 | A * | 2/1974 | Kneier | A45C 13/26 16/409 |
| 5,301,508 | A | 4/1994 | Kahl et al. | |
| D349,007 | S | 7/1994 | Costello | |
| 7,341,164 | B2 | 3/2008 | Barquist et al. | |
| 8,740,010 | B1 | 6/2014 | Page | |
| 9,278,704 | B2 | 3/2016 | Cates | |
| 9,340,224 | B2 | 5/2016 | Yoder et al. | |
| 9,341,403 | B2 | 5/2016 | Conrad et al. | |
| 9,834,240 | B2 | 12/2017 | Vanderberg et al. | |
| 11,444,649 | B1 * | 9/2022 | De Chavez | H04B 1/3888 |
| 11,840,393 | B2 | 12/2023 | Maldonado et al. | |
| 2004/0178208 | A1 | 9/2004 | Leba et al. | |
| 2018/0066882 | A1 | 3/2018 | Grepper | |
| 2022/0390163 | A1 | 12/2022 | Thelin et al. | |

FOREIGN PATENT DOCUMENTS

| | | | |
|---|---|---|---|
| WO | 9936324 | A1 | 7/1999 |

* cited by examiner

*Primary Examiner* — Don M Anderson
*Assistant Examiner* — Eric C Baldrighi
(74) *Attorney, Agent, or Firm* — Moore & Van Allen PLLC; W. Kevin Ransom

(57) ABSTRACT

The present invention provides a handle device for a lid of a compartment. The handle device comprises a housing for attachment to the lid of the compartment, where the housing comprises a slot extending into the housing from a front of the housing. A handle portion is sized to slidably fit into the slot of the housing for retraction and deployment from the housing.

13 Claims, 5 Drawing Sheets

HANDLE DEVICE FOR A LID OF A COMPARTMENT

CROSS-REFERENCE TO RELATED APPLICATION

This application is a non-provisional of and claims priority to U.S. Provisional Application No. 63/461,063 of the same title and filed on Apr. 21, 2023; the contents of which are also incorporated herein by reference.

FIELD OF THE INVENTION

The present invention relates generally to a handle for a container, such as a portable cooler, and more specifically to a retractable handle for such container.

BACKGROUND OF THE INVENTION

Ice chest/portal ice coolers are ubiquitous and have a large number of applications. A common issue with most ice coolers is opening and closing of the lid. Many times ice coolers are used in settings where the user may have other items in their hands, while trying to open a cooler. Many conventional coolers include an indent in the body of the cooler that allows for a person to insert their hand and raise the lid of the cooler. These typically require a user's hand for operation, which is difficult if the user is carrying other items.

SUMMARY OF THE INVENTION

The present invention provides a handle device for a lid of a compartment. The handle device comprises a housing for attachment to the lid of the compartment, where the housing comprises a slot extending into the housing from a front of the housing. A handle portion is sized to slidably fit into the slot of the housing for retraction and deployment from the housing.

In one embodiment, a length of the handle portion is longer than a length of the slot, such that in a fully retracted state, a portion of the handle portion protrudes from the front of the housing to thereby allow the handle portion to be grasped and deployed for use.

In one embodiment, first and second sides of the housing extend from the front of the housing to create an exposed access area in the housing.

In one embodiment, the handle portion comprises a cut out portion located in the handle portion assist a user in grasping the handle portion. In some embodiments, the cut out is either a "U" or "C" shaped section defined in a body of the handle portion.

In one embodiment, the housing comprises one or more housing stops configured to engage portions of side walls of the handle portion, when the handle portion is extended from the housing to thereby form a maximum extension of the handle portion from the housing in a deployed state.

In one embodiment, wherein the handle portion is pivotably located within the slot of the housing via a journal such that the handle portion is rotatable from a retracted to a deployed state relative to the slot of the housing.

In one embodiment, inner surfaces of side walls of the housing each comprise a groove that cooperates with a togue on a corresponding side of the handle portion.

In one embodiment, the handle portion comprises a grasping area to assist the user is grasping the handle portion for deploying or retracting the handle portion.

In one embodiment, one or more through holes are located in the housing for accepting fasteners to fasten the handle device to the lid of the compartment.

DETAILED DESCRIPTION

Figure 1:
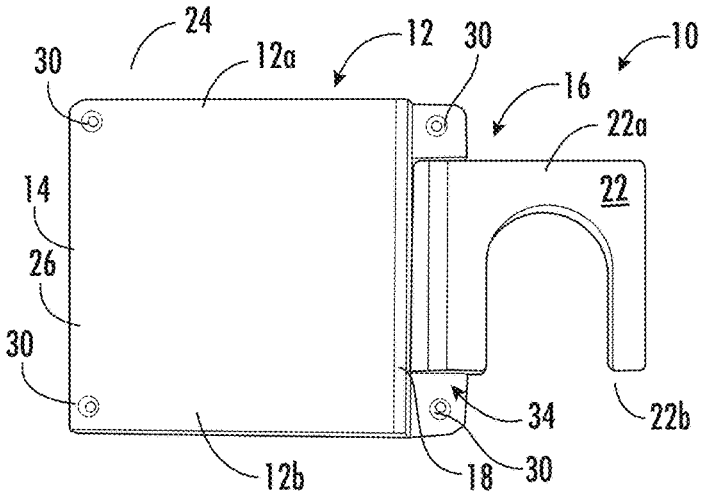
FIG. 1 is a top side view of a handle device according to one embodiment of the present invention, with the handle in a deployed state.

Provided is a retractable handle device for a lid of a compartment, such as an ice chest or portable cooler. The device 10 comprises a housing 12 having side walls 12*a*, 12*b* and a top 14. At least a front portion 16 of the housing has an opening 18 defined therein with a slot 20 extending into the housing. The device further includes a handle portion 22 for slidable location inside the housing. The handle portion comprises first 22*a* and second 22*b* sides and is sized to fit within the opening 18 in the front side of the housing and insert into the slot 20 defined in the housing. In a retracted state, a substantial portion of the handle portion 22 is located inside the slot 20 defined in the housing. In an extended state, at least a portion of the handle portion 22 extends from the opening 18 in the front of the housing, such that a front side of the handle extends out from the front portion 16 of the housing to a position where it can be grasped or otherwise accessed.

The handle device 10 is configured for attachment to the lid of a compartment 24. For example, in one embodiment, the handle device 10 can be configured to attach to the lid of an ice chest or portable cooler or a lid of a compartment on a boat, such as a live well or equipment storage. The handle device, as attached, allows for ease in opening the compartment 24 when a user's hands are full or otherwise not available. Specifically, as many coolers and other compartments may have finger insertion holes or small handles that require grasping with the hands or fingers, the lids can be difficult to grasp and open without a user's hand. The concept of the present invention is to provide a retractable handle device that can be attached to the lid with the handle being configured for manipulation by various body parts of the user, such as an arm, elbow, leg, foot, or the like.

In this regard, the handle device of the present invention is configured in various ways for location on the or in the lid of the compartment. For example, the handle device could be adhered to the lid via an adhesive, Velcro, magnetics, or other adherence means. In other embodiments, fasteners, such as screws, rivets, bolts, etc. could be used to attach the handle device to the lid.

A feature of the invention is that handle portion that is slidably positionable in the housing movable from a retracted state to a deployed state. In the retracted state, the handle portion can be located so as to not obstruct or interfere with movement about the compartment or lid. In a deployed state, the handle portion is extended from the housing in such a way to make it graspable or otherwise engaged for lifting or lowering the lid.

Figure 2A:
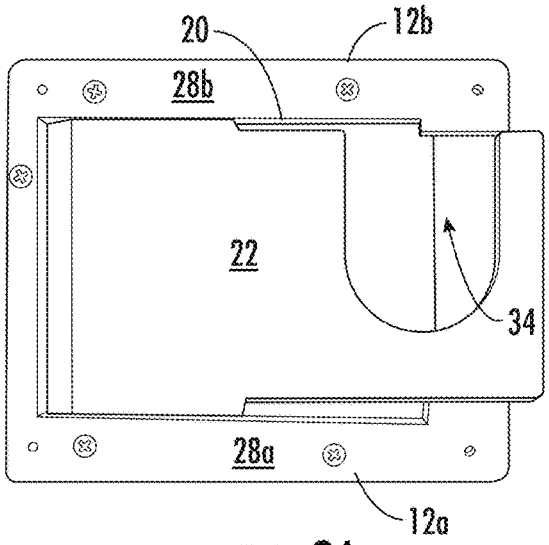
FIG. 2A is a bottom side view of a handle device according to one embodiment of the present invention, with the handle in a partially deployed state.
Figure 2B:
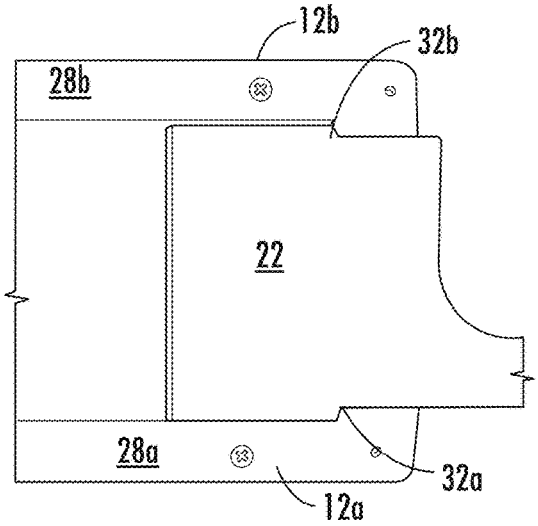
FIG. 2B is a bottom side view of a handle device according to one embodiment of the present invention, with the handle in a deployed state.
Figure 2C:
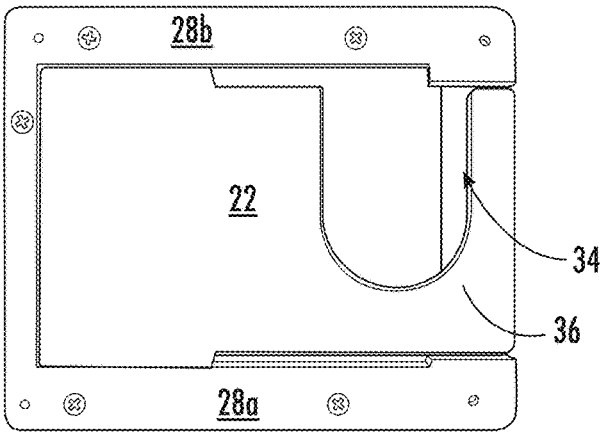
FIG. 2C is a bottom side view of a handle device according to one embodiment of the present invention, with the handle in a detracted, non-deployed state.

A first embodiment of the handle device provides a sliding configuration. As shown in FIGS. 2A-2C, the width and height of the handle portion 22 is dimensioned to be slightly smaller than the width and height dimensions of the slot 20 extending from the front portion 16 of the housing. This configuration allows the handle portion to slidingly fit within the slot 20 of the housing.

In an alternative embodiment, the inner surfaces of the side walls 12*a*, 12*b* of the housing 12 and the outer surfaces of the side walls 22*a*,22*b* of the handle portion 22 are slidably mated to each other respectively to allow the handle portion to slide relative to the sides of the housing. In one embodiment, either the inner surfaces of the housing side walls 12*a*, 12*b* or the outer surfaces of the side walls 22*a*,22*b* of the handle portion 22 has grooves that cooperate with togues or tabs on the other of the inner surfaces of the housing side walls or the outer surfaces of the side walls of the handle portion to create a "tongue and groove" slidable configuration.

In this configuration, a width of the handle portion spanning between the first and second sides is slightly smaller than a distance between the inner surfaces of the sides of the housing, but for possibly a tongue portion that fits within a groove of the side walls of the housing in one embodiment.

As illustrated the housing 12 comprises at least first and second sides 12*a*, 12*b* and a top 14. It may also include a back side 26 and a bottom side 28*a*,28*b*, depending on the configuration. Further the first and second sides 12*a*, 12*b* and the top 14 do not necessarily need to be continuous but can have open sections along their surface.

Either the bottom of the first and second sides 12*a*, 12*b* or a bottom side of the housing may be configured for adherence or attachment to the lid. For example, the bottom side may be configured to receive an adhesive, such as a glue or tape or the like or a section of Velcro for adhering to the lid. The bottom could also or alternatively have through holes 30 for accepting fasteners to fasten the handle device to the lid 24.

In some embodiments bottom surfaces of the first and second sides may be configured for receipt of an adhesive or Velcro for adhering the handle device to the lid. In some embodiments the first and second sides of the housing may have through holes for receiving fasteners to attach the handle device to the lid of s compartment.

In some embodiments, as shown in FIG. 2B, the housing may include one or more housing stops 32*a*, 32*b* configured to engage portions of the side walls 22*a*,22*b* of the handle portion 22, when the handle portion is extended to thereby form a maximum extension of the handle portion from the housing 12 in the deployed state. One or more stops of different configurations and/or locations are contemplated for use in engaging either the sides, top, and/or bottom surface of the handle portion 22, depending on the configuration.

As shown in FIGS. 2A and 2B, in some embodiments, the housing stops 32*a*,32*b* extend from the opposing side walls 12*a*, 12*b* of the housing 12 into the slot 20 to create a narrowed area. In this embodiment, when the handle portion 22 is extended from the front portion 16 of the device, the housing stops 32*a*,32*b* come into contact with the slides of the handle portion 22, limiting further extension of the handle portion 22 from the front portion 16 of the housing.

As shown in FIGS. 1 and 2A-2C, in one or more embodiments, the first and second sides 12*a*, 12*b* of the housing may extend further from the front of the housing than the top 14 of the housing to create an exposed access area 34 in the housing. In this embodiment, the length of the handle portion is configured such that when the handle portion is fully retracted into the slot in the housing, at least a portion of the handle portion is accessible via the access area 34 in the top of the housing. This embodiment allows a user to gain access to the handle portion for deploying same for use. In other words, the access area 34 exposes the second side 22*b* of the handle portion 22, such that it can be grasped or otherwise manipulated by a user.

Figure 5:
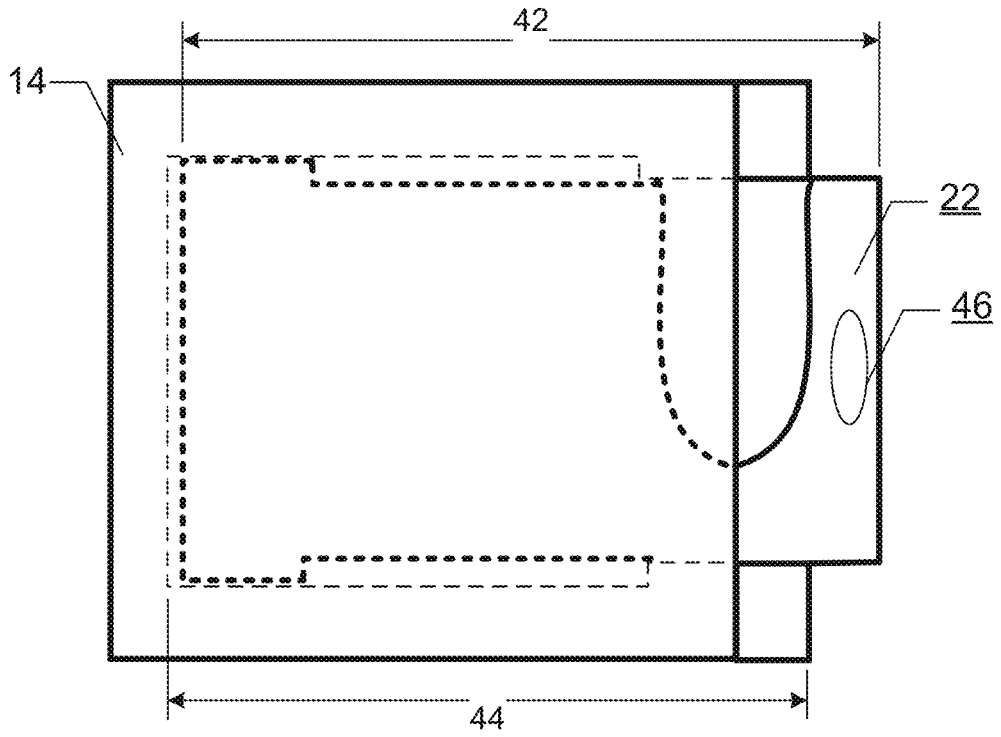
FIG. 5 is a top side view of a handle device according to one embodiment of the present invention, with the handle in a partially deployed state via rotation relative to the housing.

In one alternative embodiment as shown in FIG. 5, in addition to or without the access area in the housing, the length 42 of the handle portion 22 may be configured to be slightly longer than the length dimension 44 of the slot 20 in the housing 12, such that in the fully retracted state, a portion of the handle portion protrudes from the front of the housing to thereby allow the handle portion to be grasped and deployed for use.

In some embodiments, the handle portion may include a grasping area 46, such as a detent or a raised portion or a knob or bumps or roughened area on one or both sides of the handle portion 22 to assist the user is grasping the handle portion for deploying or retracting the handle portion.

As shown in FIG. 2C, the handle portion 22 may include a cut out portion 36 to assist a user in grasping the handle portion for either deployment or use in raising and lowering the lid or both operations. In one embodiment, the cut out is a "U" or "C" shape section 36 defined in the body of the handle portion 22. As will be understood, the cut out may be of any desired shape. It could be a circular, square, or other shaped through hole.

Figure 3A:
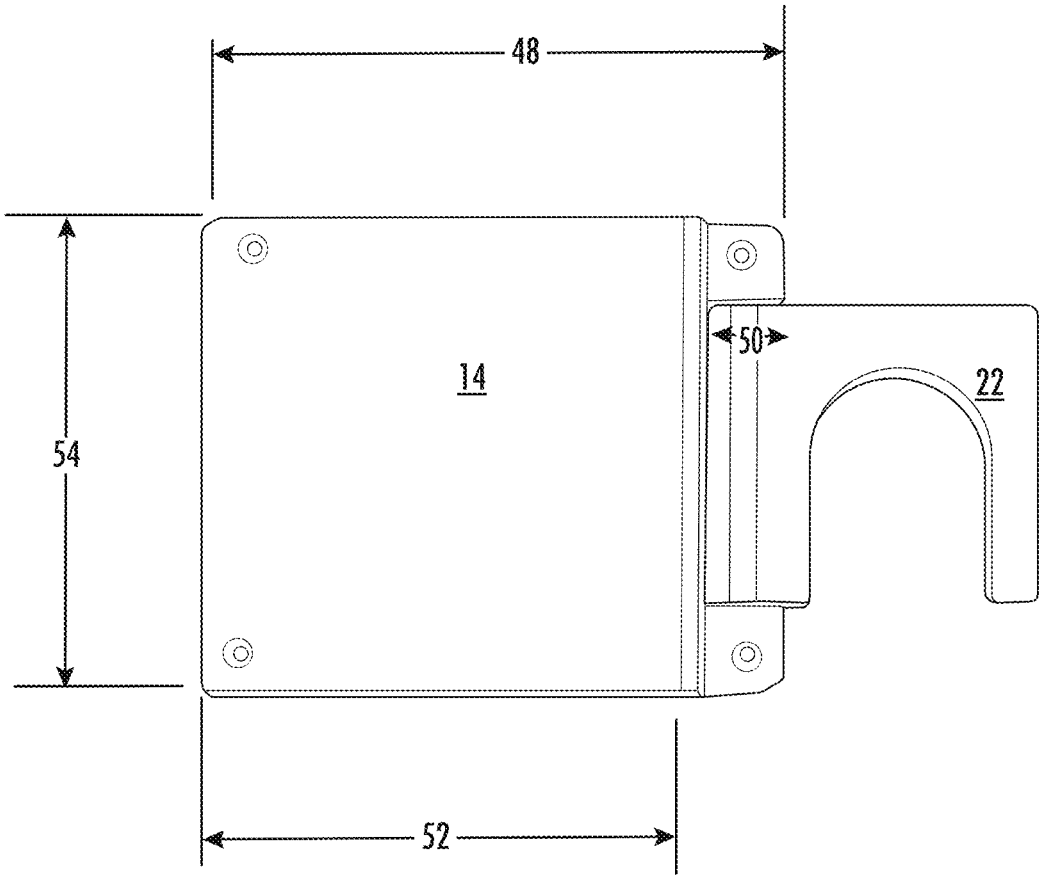
FIG. 3A is a top side view of a handle device according to one embodiment of the present invention, with the handle in a deployed state.
Figure 3B:
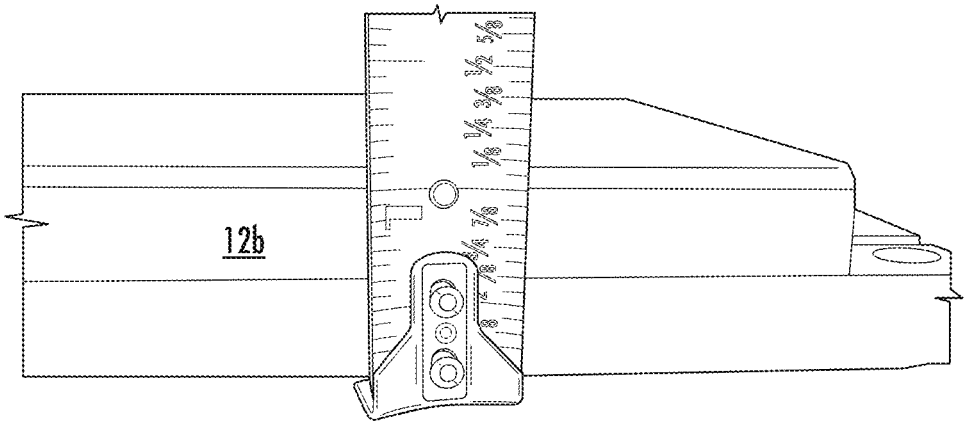
FIG. 3B is a side view of a handle device according to one embodiment of the present invention, with the handle in a detracted, non-deployed state.

FIGS. 3A-3B illustrate and embodiment of the handle device with dimensions. In this embodiment, the length 48 of the first and second sides 12*a*, 12*b* of the housing is 6.5 inches, the access area 34 has a length 50 of ⅞ inches, and the top 14 has a length or 5⅝ inches long. The width 54 of the housing 14 is 5⅝ inches. The height of the housing is 1⅛ inches.

Figure 4:
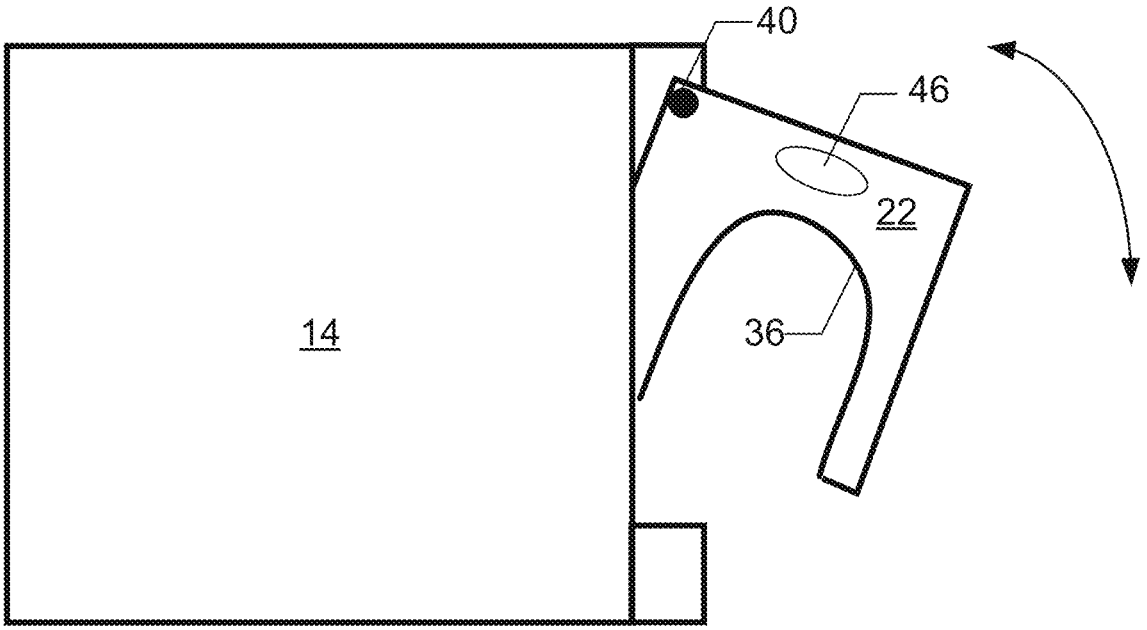
FIG. 4 is a top side view of a handle device according to one embodiment of the present invention, with the handle in a partially deployed state via rotation relative to the housing.

FIG. 4 provides an embodiment of the retractable handle device according to another embodiment. In this embodiment, the handle portion 22 is pivotably located within the cavity of the housing via a journal 40. The handle portion is rotated from a retracted to a deployed state.

Figure 6A:
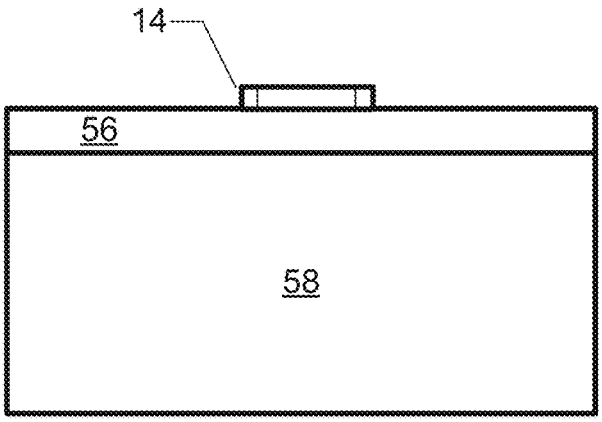
FIG. 6A is front side view of a compartment with a lid with a handle device according to one embodiment of the present invention attached to the lid.
Figure 6B:
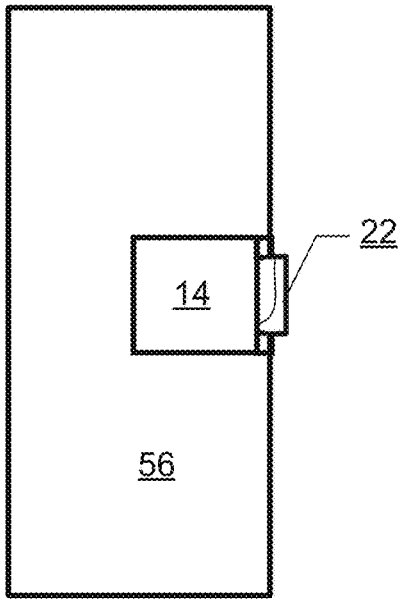
FIG. 6B is top side view of the compartment with a lid of FIG. 5A with a handle device according to one embodiment of the present invention attached to the lid.

FIG. 6 illustrates the handle device 10, according to one embodiment of the invention, mounted on the lid 56 of a portable cooler 58.

Other configurations of the handle device are envisioned with the idea being that the handle device is connectable to a lid of a compartment, is available in a deployed state to be manipulated by a body part of a user, e.g., hand, arm, elbow, leg, knee, foot, etc., and can be retracted when not in use. For example, in one embodiment, the handle could be configured in a telescoping manner to retract into a central holder and deploy in a telescoping manner therefrom.

It is understood that handle device may be made of any suitable rigid material, such as plastic, wood, metal, and the like.

The invention claimed is:

1. A handle device for a lid of a compartment comprising:

a housing for attachment to the lid of the compartment, said housing comprising first and second opposing side walls, an enclosed back wall, and a front wall, wherein the front wall comprises a slot extending into the housing; and a handle portion comprising front and back ends and two opposing sides, wherein said handle portion is sized to slidably fit into the slot of said housing for retraction into and deployment from the housing, wherein in a retracted position, the back end and at least a portion of the two opposing sides of the handle portion are located inside the housing.

2. A handle device according to claim 1, wherein a length of the handle portion is longer than a length of the slot, such that in a fully retracted state, a portion of the handle portion protrudes from the front of the housing to thereby allow the handle portion to be grasped and deployed for use.

3. A handle device according to claim 1, wherein first and second opposing side walls of the housing extend from the front of the housing to create an exposed access area in the housing.

4. A handle device according to claim 1, wherein the handle portion comprises a cut out portion located in the handle portion to assist a user in grasping the handle portion.

5. A handle device according to claim 4, wherein the cut out portion is either a "U" or "C" shaped section defined in a body of the handle portion.

6. A handle device according to claim 1, wherein the first and second opposing side walls of the housing each comprises one or more housing stops configured to engage portions of the opposing sides of the handle portion, when the handle portion is extended from the housing to thereby form a maximum extension of the handle portion from the front wall of the housing in a deployed state.

7. A handle device according to claim 1, wherein the handle portion is pivotable and located within the slot of the housing via a journal such that the handle portion is rotatable from a retracted to a deployed state relative to the slot of the housing.

8. A handle device according to claim 1, wherein inner surfaces of each of the first and second opposing side walls of the housing each comprise a groove that cooperates with a tongue on a corresponding side of the handle portion.

9. A handle device according to claim 1, wherein the handle portion comprises a grasping area to assist the user is grasping the handle portion for deploying or retracting the handle portion.

10. A handle device according to claim 1 comprising one or more through holes in the housing for accepting fasteners to fasten the handle device to the lid of the compartment.

11. A handle device according to claim 1, wherein the compartment is a cooler and the lid is pivotably connected to the compartment at a first side of the lid, and wherein said handle portion is configured to be attached to the lid at an opposed second side of the lid, such that said handle portion in a deployed position extends away from the second side of the lid and away from the compartment.

12. A handle device according to claim 1, wherein the handle portion is pivotable and located within the slot of the housing via a journal located adjacent to the front wall of the housing, such that the handle portion is rotatable from a retracted to a deployed state relative to the slot in the front wall of the housing.

13. A handle device according to claim 1, wherein first and second opposing side walls of the housing extend from the front of the housing to create an exposed access area in the housing, and wherein in the retracted position, the front end of the handle is located in the exposed access area of the housing.

* * * * *